US007344094B1

(12) United States Patent
Tracy et al.

(10) Patent No.: US 7,344,094 B1
(45) Date of Patent: Mar. 18, 2008

(54) FLEXIBLE NECK FAUCET SPRAYER

(75) Inventors: Martin Tracy, 546 Whitevale Rd., Whitevale, Ontario (CA) L0H 1M6; Peter Colpitts, Uxbridge (CA)

(73) Assignee: Martin Tracy, Whitevale (CA)

( * ) Notice: Subject to any disclaimer, the term of this patent is extended or adjusted under 35 U.S.C. 154(b) by 0 days.

(21) Appl. No.: 11/539,017

(22) Filed: Oct. 5, 2006

(51) Int. Cl.
*B05B 15/08* (2006.01)

(52) U.S. Cl. ..... 239/588; 239/428.5; 239/446; 239/449; 239/587.1; 239/600; 239/602; 239/DIG. 12; 285/8; 285/226

(58) Field of Classification Search ..... 239/24, 239/25, 30, 428.5, 443, 445, 446, 449, 505, 239/516, 519, 587.1, 588, 600, 602, DIG. 12; 4/567, 615, 675, 678; 285/8, 223, 226, 235, 285/239
See application file for complete search history.

(56) References Cited

U.S. PATENT DOCUMENTS 2,476,079 A * 7/1949 Benjamin, Jr. ..... 285/8
3,067,952 A * 12/1962 Aglmides ..... 239/428.5
3,131,868 A * 5/1964 Coleman ..... 239/588
3,358,934 A * 12/1967 Moen ..... 239/428.5
3,796,378 A * 3/1974 Flater ..... 239/447
4,018,386 A * 4/1977 Barichello ..... 239/588
4,179,142 A * 12/1979 Schopp ..... 285/239
4,314,717 A * 2/1982 Bjurman ..... 239/588

* cited by examiner

*Primary Examiner*—Steven J. Ganey
(74) *Attorney, Agent, or Firm*—Laurence P. Colton; Smith, Gambrell & Russell

(57) ABSTRACT

A sprayer for attachment to the spout of a faucet. The sprayer comprises a coupling, a spray head through which fluid may be directed for expulsion and a neck portion. The coupling releasably secures the sprayer to the spout of a faucet. The neck portion connects the coupling to the spray head and includes a passageway permitting the flow of fluid from the spout of the faucet to the spray head. The neck portion is flexibly resilient and permits the spray head to be displaced from a rest position where it is generally aligned with the longitudinal axis of the sprayer to a deflected position where it is deflected from its rest position. The resiliency of the neck portion causes the spray head to be normally biased toward its rest position. The neck portion further includes a deflection limiter preventing the spray head from being deflected more than a pre-determined amount from the longitudinal axis of the sprayer.

12 Claims, 12 Drawing Sheets

FLEXIBLE NECK FAUCET SPRAYER

FIELD OF THE INVENTION

This invention relates to faucet sprayers and in particular to a unique flexible neck faucet sprayer.

BACKGROUND OF THE INVENTION

Sprayers or sprayer attachments are widely used on the faucets of kitchen sinks, washroom lavoratories, laundry room sinks and for a wide variety of other applications. Generally faucet sprayers are threaded or otherwise attached to the spout of a faucet to allow a user to adjust the faucet discharge from a stream, which may include an aerated stream, to a spray, or a combination of a stream and a spray.

The first significant introduction of faucet sprayers into the marketplace occurred in or around the late 1940's. At that time various manufacturers offered a flexible rubber sprayer that could be press-fit onto the end of an unthreaded faucet spout. Somewhat later the same sprayer was supplied with a threaded coupling that allowed it to be threaded onto the end of faucets having either internal or external threads.

This early form of faucet sprayer was generally a low-pressure sprayer, as the flow of water was not impeded in any significant manner. The holes to the sprayer were sufficiently large and numerous to prevent the build-up of pressure within the sprayer body, hence preventing the sprayer body from expanding like a balloon or causing the internal pressure to blow the sprayer off the end of the faucet. The diameter of the holes and their number generally resulted in water exiting the sprayer in a series of small low pressure streams.

In or around the 1960's higher pressure faucet sprayers were developed which were different from the previous low pressure sprayers in two significant ways. First, the high pressure sprayers were sealed units that allowed a build-up of water pressure within them so that high pressure could be forced through smaller spray holes, thus producing a strong rinsing-type spray. In many cases an aerator was added that, together with the high build up of pressure water within the sprayer body, was capable of providing a strong aerated stream when desired.

The second primary advancement that came about when high pressure sprayers were designed was the incorporation of a swivel or ball and socket type joint that allowed the direction of the spray to be altered. In addition, the sprayers were formed from hard plastic or metallic bodies that were designed to withstand the increased pressure and that also facilitated the use of a vertical valve arrangement within the sprayer to permit a consumer to switch from a spray to an aerated flow pattern. Such high pressure sprayers remain in wide use today and are manufactured in numerous sizes and physical configurations.

Although high pressure faucet sprayers provide a number of advantages over previous low pressure devices, currently available faucet sprayers still suffer from a number of inherent limitations. First, the vertical valving structure that is utilized on most sprayers requires a user to grasp and physically pull down or push up upon the spray head in a vertical plane in order to change from a spray to an aerated flow pattern. Such movements can put a considerable amount of torque or stress upon the faucet, as well as the faucet/sprayer connection. Where the hardness of the water is relatively high, mineral deposits within the sprayer body can make it difficult to switch between a spray and an aerated flow pattern, thereby requiring the application of additional force and putting yet further strain upon the faucet and the sprayer/faucet connection. Mineral deposits also tend to accumulate on ball and socket or swivel joints making them difficult to operate.

Currently available faucet sprayers also provide only a limited ability for moving the spray head relative to the faucet and angling the discharge away from a vertical plane. To increase the range of movement others have suggested the use of a double ball and socket type structure. To some degree a double ball and socket structure increases the ability to direct the spray further from a vertical plane, however, only at the expense of a more complicated mechanical structure, increased cost, and even greater susceptibility to the negative effects of hard water.

SUMMARY OF THE INVENTION

The invention therefore provides a new and novel faucet sprayer that addresses a number of the limitations of currently available products.

In one aspect the invention provides sprayer for attachment to the spout of a faucet, the sprayer comprising a coupling for releasably securing said sprayer to the spout of a faucet; a spray head through which fluid may be directed for expulsion from said sprayer; and, a neck portion connecting said coupling to said spray head, said neck portion including a passageway permitting the flow of fluid from the spout of the faucet to said spray head, said neck portion flexibly resilient and permitting said spray head to be displaced from a rest position where said spray head is generally aligned with the longitudinal axis of said sprayer to a deflected position where said spray head is deflected from said rest position, said resiliency of said neck portion causing said spray head to be normally biased toward said rest position, said neck portion further including a deflection limiter preventing said spray head from being deflected more than a pre-determined amount from the longitudinal axis of said sprayer.

In another aspect the invention concerns a sprayer for attachment to the end of a conduit, the sprayer comprising a coupling for releasably securing said sprayer to the end of the conduit; a spray head through which fluid may be directed for expulsion from said sprayer; and, a flexibly resilient neck portion connecting said coupling to said spray head and including an internal passageway permitting the flow of fluid from the conduit to said spray head, said flexibility and resiliency of said neck portion permitting said spray head to be displaced from a rest position where said spray head is generally aligned with the longitudinal axis of said sprayer to a deflected position where said spray head is deflected from said rest position upon the application of a force to either or both of said neck portion and said spray head at an angle to the longitudinal axis of said sprayer, said resiliency of said neck portion causing said spray head to return to said rest position upon removal of said force, said neck portion further including a deflection limiter preventing said spray head from being deflected more than a pre-determined amount from the longitudinal axis of said sprayer.

In yet a further aspect the invention provides a sprayer for attachment to the spout of a faucet, the sprayer comprising a coupling for releasably securing said sprayer to the spout of the faucet; a spray head through which fluid may be directed for expulsion from said sprayer; and, a neck portion connecting said coupling to said spray head, said neck portion including a passageway permitting the flow of fluid from the spout of the faucet to said spray head, said neck portion flexibly resilient and permitting said spray head to be displaced from a rest position where said spray head is generally aligned with the longitudinal axis of said sprayer to a deflected position where said spray head is deflected from said rest position, said resiliency of said neck portion causing said spray head to be normally biased to said rest position, said neck portion further including a series of ring members spaced apart along the longitudinal axis of said neck portion, when said spray head is deflected by a pre-determined amount from the longitudinal axis of said sprayer said ring members contacting one another and limiting further deflection of said spray head away from the longitudinal axis of said sprayer.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENTS

The present invention may be embodied in a number of different forms. However, the specification and drawings that follow describe and disclose only some of the specific forms of the invention and are not intended to limit the scope of the invention as defined in the claims that follow herein.

Figure 1:
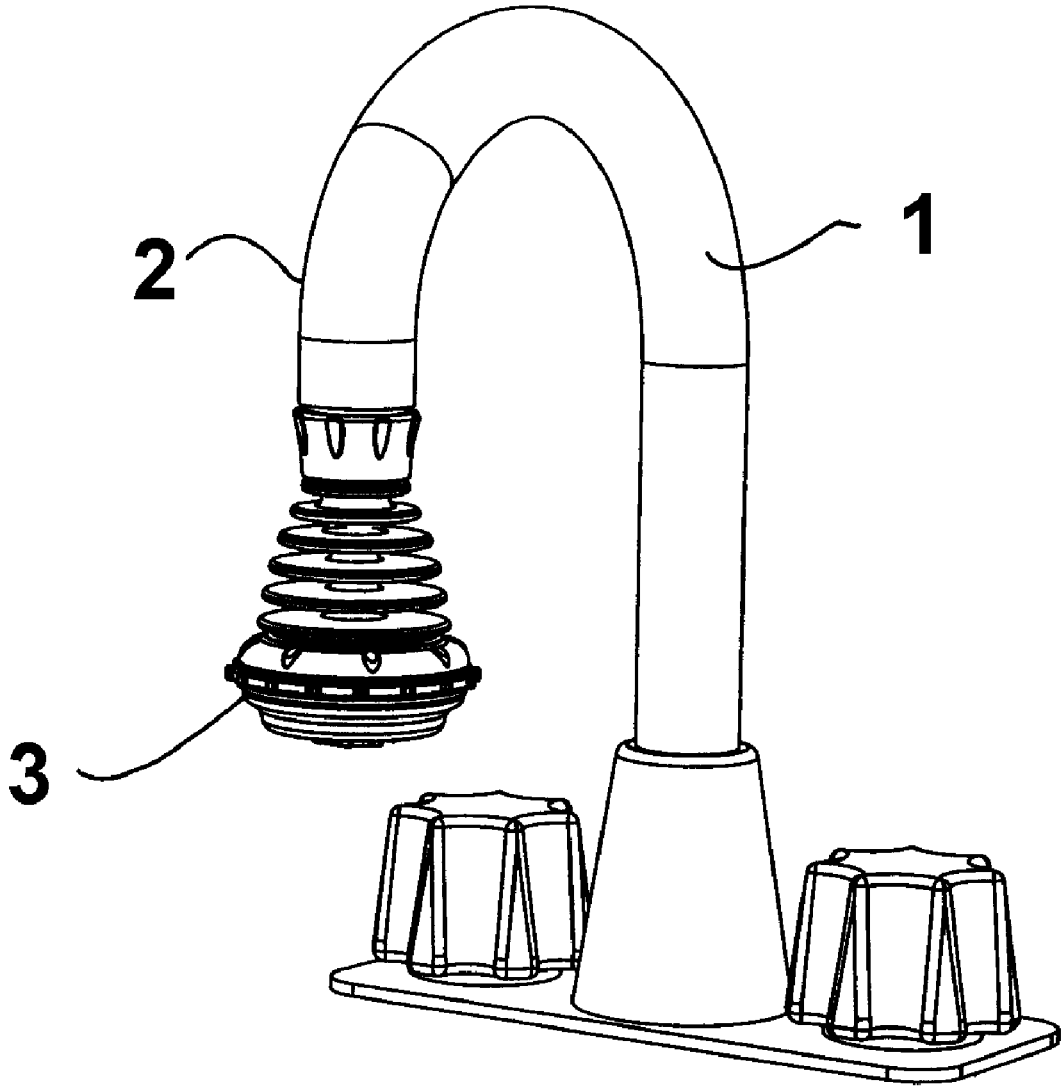
FIG. 1 is a side perspective view of a typical faucet having attached thereto a faucet sprayer constructed in accordance with one of the preferred embodiments of the present invention.
Figure 2:
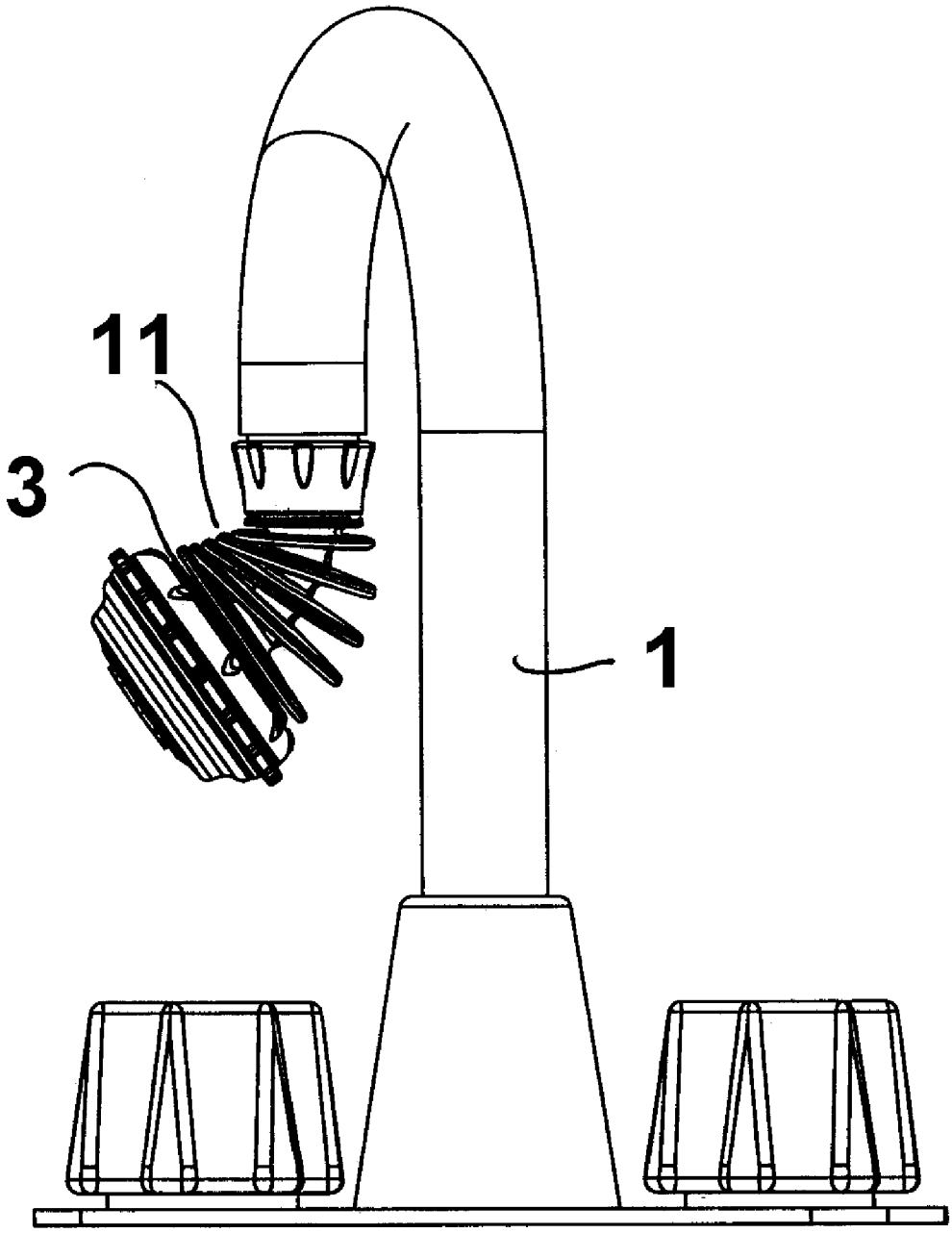
FIG. 2 is a view similar to FIG. 1 wherein the faucet sprayer has been deflected such that its discharge is in a non-vertical orientation.
Figure 3:
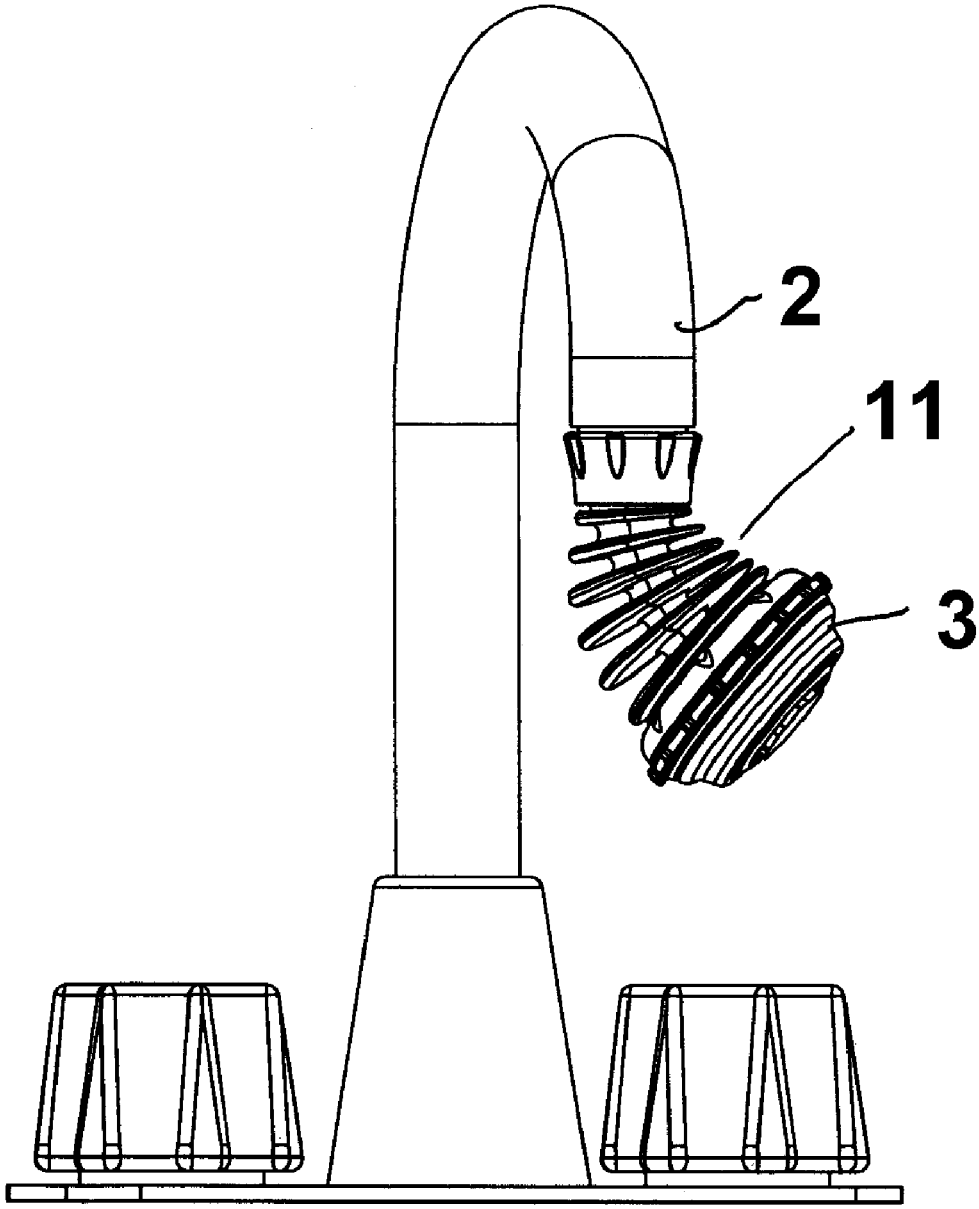
FIG. 3 is a view similar to FIG. 2 with the faucet sprayer in a different orientation.
Figure 4:
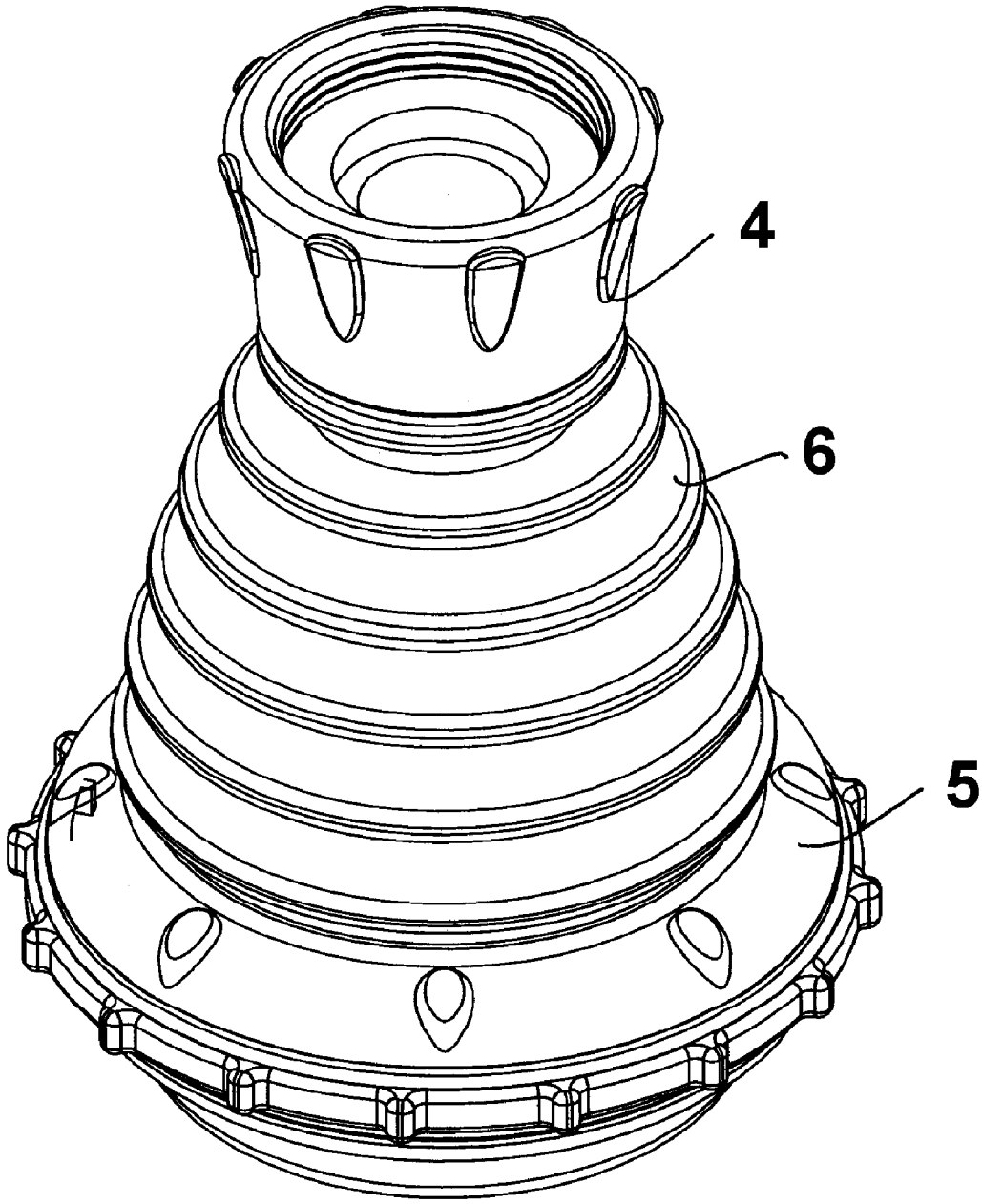
FIG. 4 is an upper side perspective view of the faucet sprayer of FIG. 1.
Figure 5:
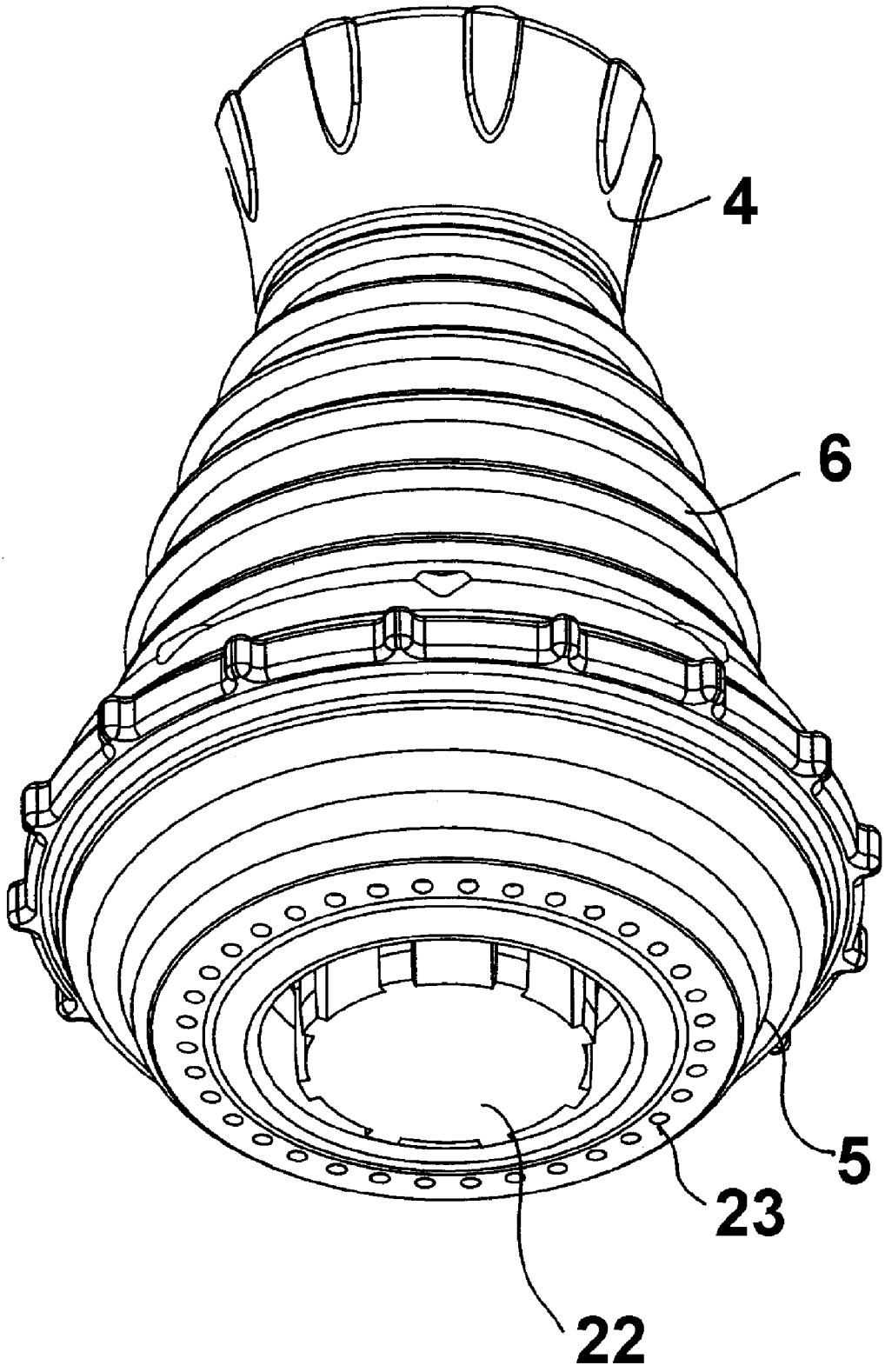
FIG. 5 is a lower side perspective view of the faucet sprayer of FIG. 1.
Figure 6:
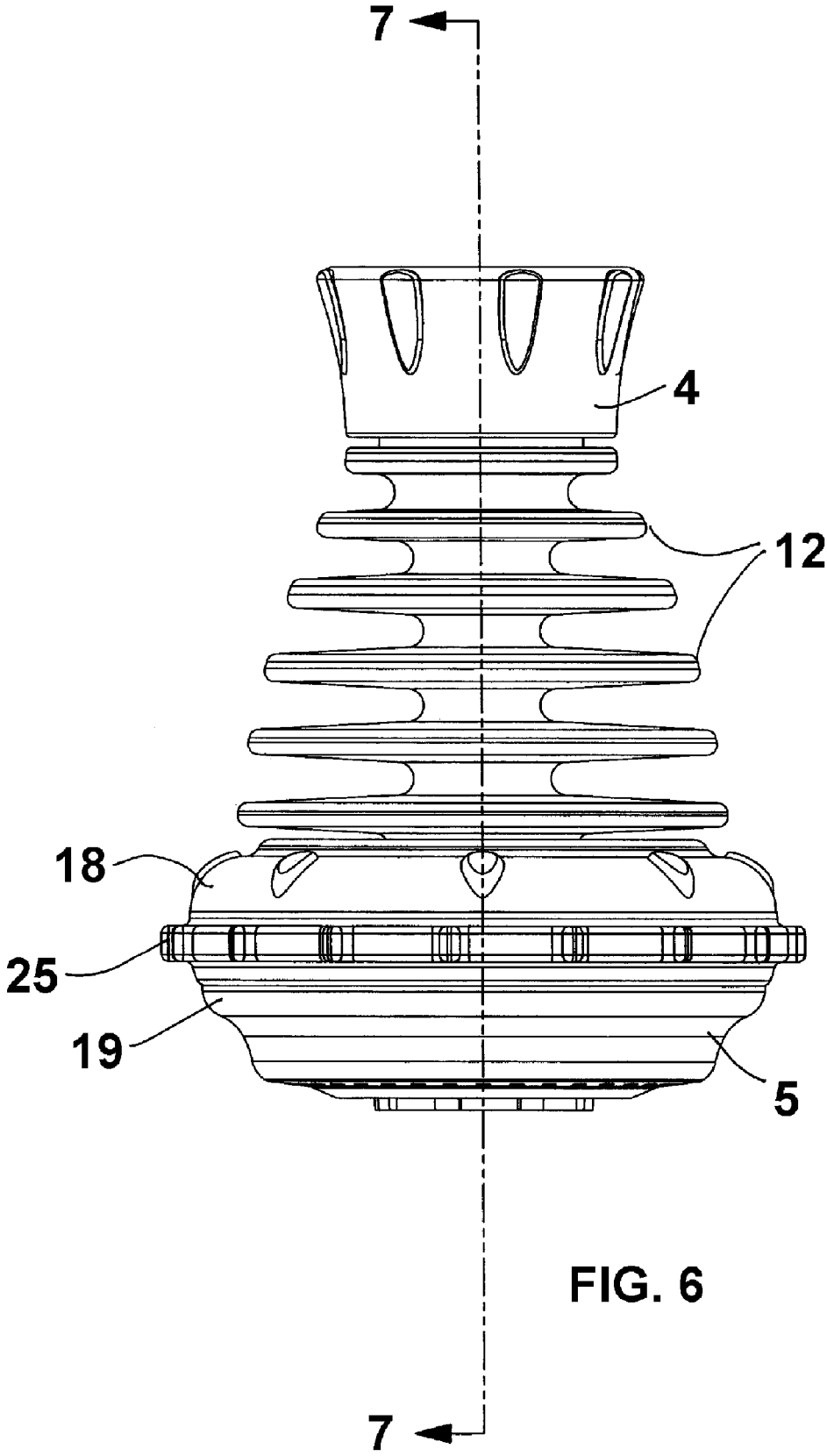
FIG. 6 is a side elevational view of the faucet sprayer shown in FIG. 1.

In FIG. 1 there is shown a typical or generic form of faucet 1 having a spout 2 that has attached to its end a sprayer 3 constructed in accordance with one of the preferred embodiments of the present invention. Sprayer 3 is formed generally from a coupling 4, a spray head 5 and a neck portion 6 that connects coupling 4 to spray head 5. Sprayer 3 in FIG. 1 is shown as it would appear normally in a rest position wherein the coupling, neck portion and spray head all lie along the same general longitudinal axis. In FIGS. 2 and 3 the spray head has been deflected away from the longitudinal axis of the sprayer.

As shown in the attached drawings, coupling 4 serves the purpose of providing a means to releasably secure the sprayer to the end of a spout of a faucet, or in an alternate embodiment to the end of a fluid carrying conduit or other structure. In most instances it is expected that the interior surface of coupling 4 will be threaded to permit the coupling to be threadably secured over the end of a faucet spout, however, it should also be appreciated that a wide variety of other means for attachments could be used, including compression fittings.

Figure 7:
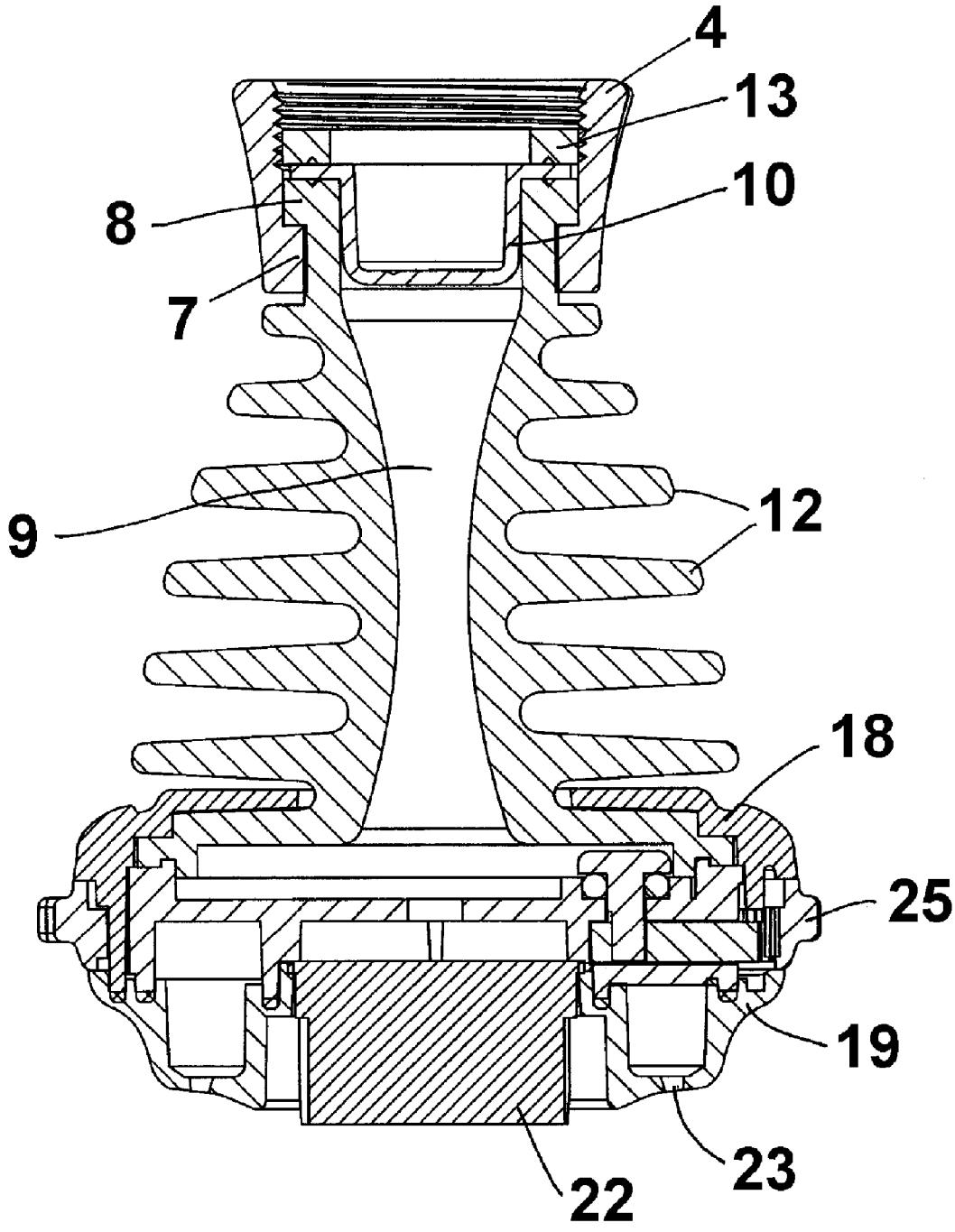
FIG. 7 is a vertical sectional view taken along the line 7-7 of FIG. 6.
Figure 8:
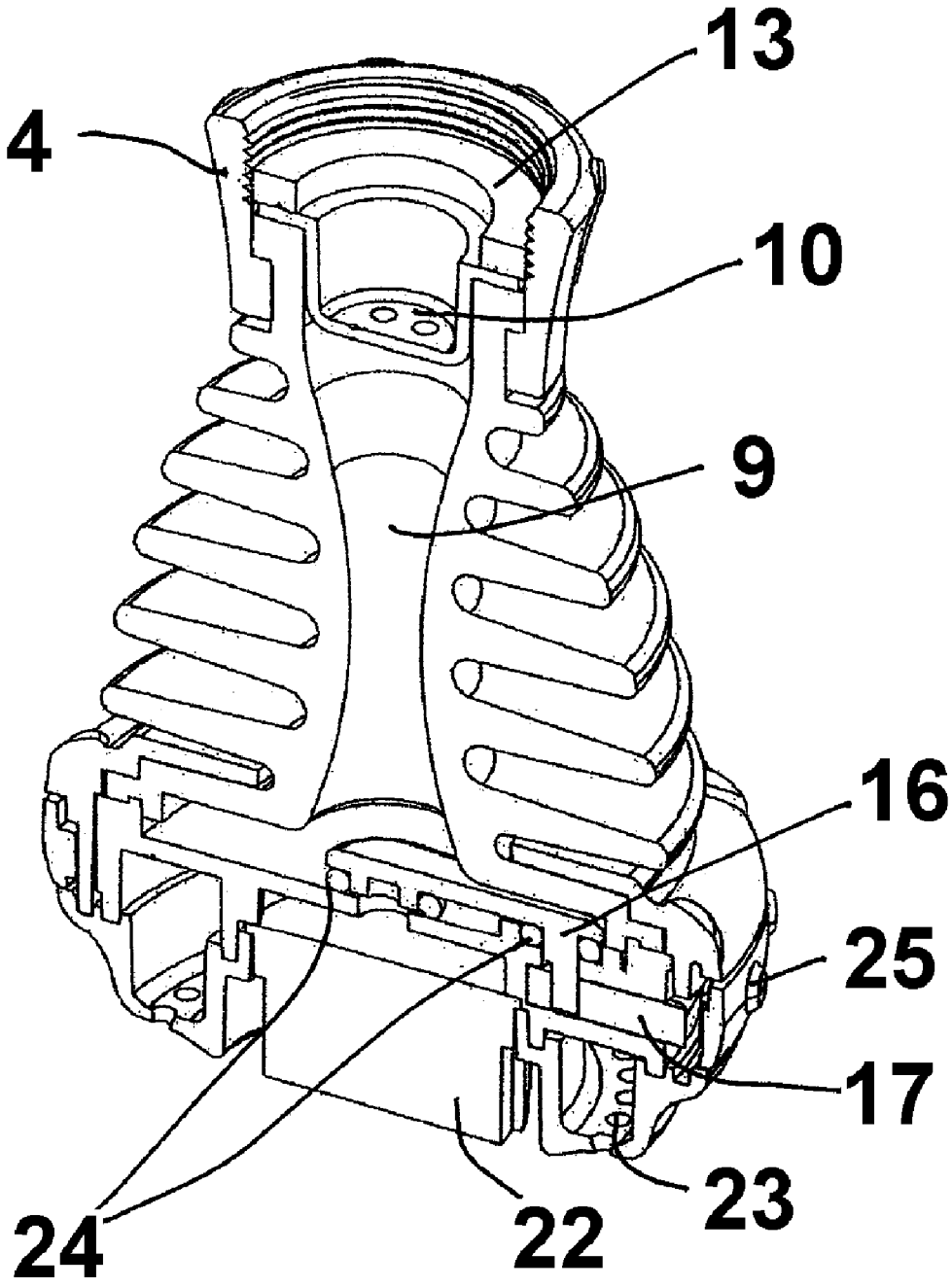
FIG. 8 is an upper side perspective view of a vertical section taken through the faucet sprayer of FIG. 1 in a position different from that shown in FIG. 7.

As is shown in FIG. 7, the lower end of coupling 4 is preferably fitted with an internal flange 7 that is dimensioned so as to mate with an external radial flange 8 on the upper end of neck portion 6 to allow the coupling to be secured to the upper end of the neck portion. As will be discussed in further detail below, neck portion 6 is preferably formed from a rubber or thermoplastic material such that when coupling 4 is threadably received onto the end of the spout of a faucet, flanges 7 and 8 will be compressed together to present a fluid tight seal therebetween.

Spray head 5 serves the general function of providing a mechanism by which fluid may be directed for expulsion from sprayer 3. One particular preferred embodiment of spray head 5 is shown in the attached drawings, however, it will be appreciated by those skilled in the art that variations to the design of the spray head could be made while still remaining within the broad scope of the current invention. In one preferred embodiment the spray head is capable of providing both an aerated and a spray discharge since most consumers that utilize faucet sprayers require the ability to change between an aerated stream and a concentrated spray discharge.

Referring again to FIG. 7, in order to permit the flow of water or other fluid from spout 2 through spray head 5, neck portion 6 includes a passageway 9 connecting the hollow interior of coupling 4 with the spray head. In this manner fluid can pass through the faucet spout into coupling 4, through passageway 9, into spray head 5 and ultimately out the bottom of the spray head in either an aerated or concentrated spray form. As is also shown in FIG. 7, in one embodiment of the invention a flow restrictor 10 may be inserted within coupling 4 and/or passageway 9 in order to restrict or limit the flow of fluid through the spray head to a pre-determined flow rate for a pre-determined range of fluid pressures. For water conservations purposes, numerous jurisdictions around the world have preset maximum flow limits for water faucets and the use of a flow restrictor allows sprayer 3 to comply with any such regulations. The placement of the flow restrictor within coupling 4 or the upper end of passageway 9 also allows the flow restrictor to be easily replaced to permit compliance with differing flow limitations that may be present in various jurisdictions. For reasons that will become more apparent from a thorough understanding of the embodiment of the invention shown in the attached drawings, it has been found that while a flow restrictor having a single hole or aperture is sufficient to limit the flow to a desired rate, a single hole has a tendency of creating a single jet spray that is directed downwardly into spray head 5, and that in some instances may interfere with the ease of operation of the spray head itself. Accordingly, in the embodiment depicted in flow restrictor 5 contains five smaller holes that have a tendency of breaking up the flow of fluid through passageway 9 and minimizing the impingement of the downward spray upon spray head 5. A washer or seal 13 may be inserted into coupling 4 above the flow restrictor to seal against the end of spout 2 and to prevent leakage of fluid between coupling 4 and the spout.

As mentioned, neck portion 6 is preferably formed from a rubber or other thermoplastic material, however, regardless of the particular material from which neck portion 6 is comprised, in accordance with the present invention the neck portion is flexibly resilient to permit spray head 5 to be displaced from a rest position where the spray head is generally aligned with the longitudinal axis of the sprayer (as shown in FIG. 1) to a deflected position where the spray head is deflected from its rest position (examples of which are shown in FIGS. 2 and 3). Deflection of the spray head from its rest to its deflected position would normally be achieved through the application of a sideways or lateral force applied to spray head 4 and/or neck portion 6, thereby causing the deflection of the spray head and permitting the stream or spray of fluid exiting through the bottom of the spray head to be maneuvered or directed as desired (for example as would be the case when an individual wishes to wash down the side of a sink). The resiliency of neck portion 6 causes the spray head to be normally biased to its rest position and as a result allows the spray head to move back to its rest position where it is generally aligned with the longitudinal axis of sprayer 3 when the force that initially deflected it is removed.

In accordance with the present invention neck portion 6 further includes a deflection limiter 11 that prevents spray head 4 from being deflected more than a pre-determined amount or degree from the longitudinal axis of sprayer 3. While it will be appreciated that the pre-determined amount of deflection may vary considerably depending upon the application at hand, in most instances the deflection of the spray head will be limited to less than approximately 90 degrees, thereby preventing spray from being directed over the side of a sink.

Figure 10:
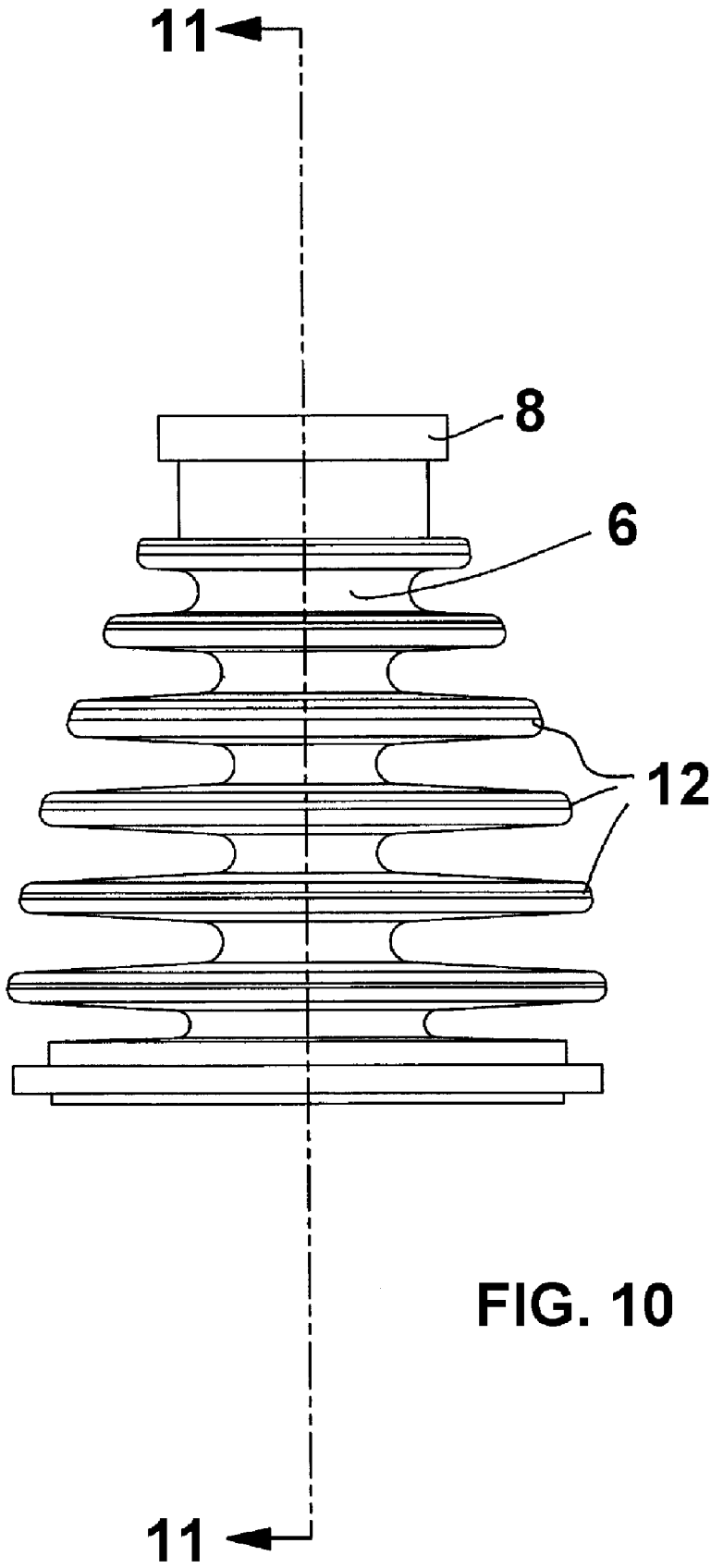
FIG. 10 is a side elevational view of the flexible neck portion of the faucet sprayer shown in FIG. 1.
Figure 11:
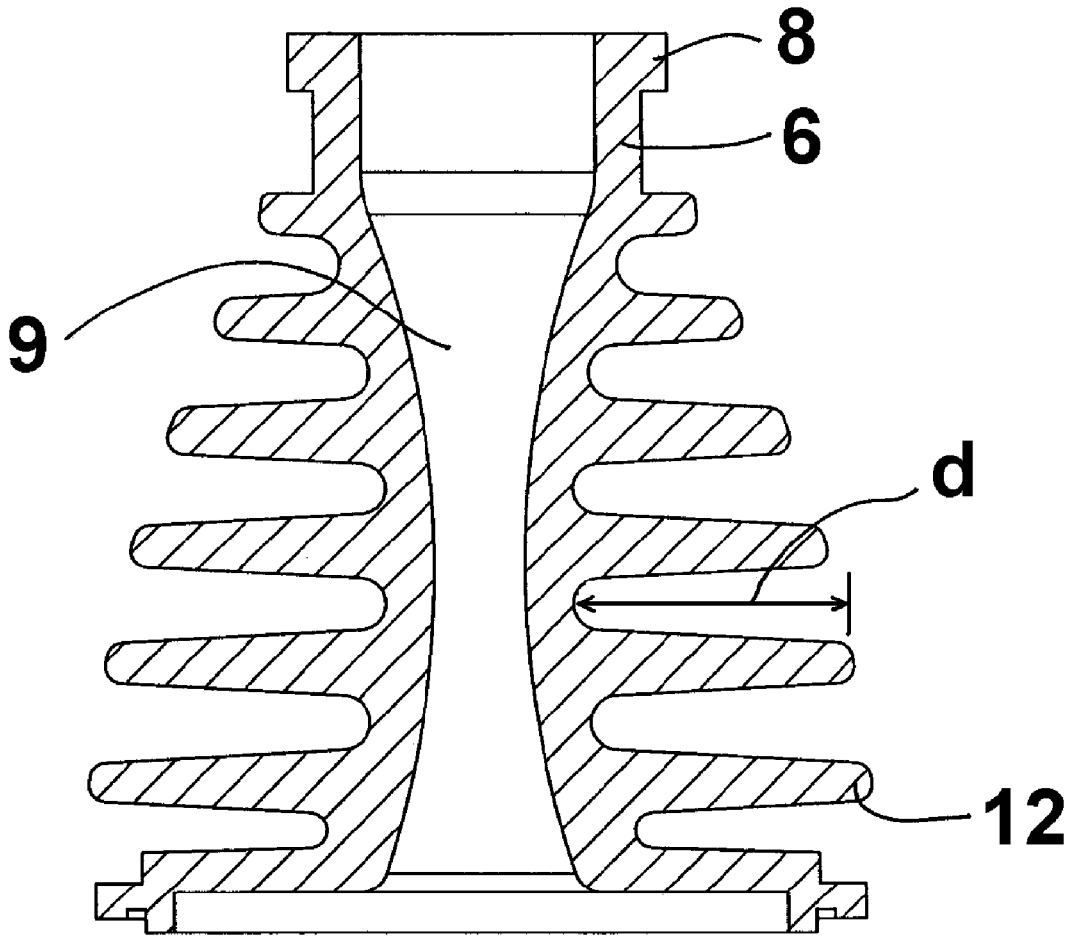
FIG. 11 is a sectional view taken along the line 11-11 of FIG. 10.

In the embodiment of the invention shown in the attached drawings, deflection limiter 11 is comprised of a series of rings or ring members 12 that are spaced apart along the longitudinal axis of the neck portion. With reference to FIGS. 7, 10 and 11, in one preferred embodiment of the invention ring members 12 are approximately equally spaced apart along the longitudinal axis of the neck portion with the diameter of the ring members increasing in a direction downwardly from the coupling to the spray head. That is, adjacent rings spaced apart downwardly along the longitudinal axis are formed with increasing diameters. It will, however, be appreciated that the structure of neck portion 6 in these regards could effectively be reversed with the diameter of the ring members decreasing in a direction downwardly from the coupling to the spray head. In either instance, when force is applied to either the neck portion or the spray head, the spray head will be deflected from its rest position. As the angle of deflection of the spray head increases, eventually the ends of adjacent ring members will come into contact with one another to the point that further deflection of the spray head away from its rest position will be restricted or limited by the compression of the ends of the rings. Such a situation is shown in FIG. 2.

Accordingly neck portion 6 serves the function of limiting the spray head from being deflected by more than a pre-determined amount from the longitudinal axis of the sprayer and thereby helps to prevent the likelihood that spray will be directed over the sides of a sink upon which faucet 1 is mounted. It will also be appreciated that the flexibly resilient nature of neck portion 6 and the circular shape of ring members 12 will permit deflection of spray head 5 in any direction that may desired, and not merely in set or finite positions. Such a structure therefore provides the consumer with virtual unlimited flexibility as to where the discharge from the sprayer may be directed, with the exception of limiting the discharge to a pre-determined angle from horizontal. In addition, it has been found that the described structure of neck portion 6, including ring members 12, helps to prevent a kinking of the neck portion and the closing off or restricting of flow through passageway 9 when the spray head is deflected from its rest position. That is, not only does the interaction of the ring members prevent deflection of the spray head beyond a pre-determined amount, it also effectively prevents passageway 9 from being kinked.

In order to enhance the flexibility of neck portion 6 and to further help prevent the kinking of the neck when the spray head is displaced from its rest position, in one of the preferred embodiments of the invention passageway 9 through neck portion 6 is generally hour glass shaped (see FIG. 11). As shown in FIG. 11, the hour glass shape of passageway 9 has the effect of making the radial depth (shown as "d" in FIG. 11) of ring members 12 greatest toward the middle of neck portion 6 and least at the upper end and lower ends of the neck portion. Such a structure has been found by the applicant to be advantageous in encouraging the neck to be bend near its middle portion when the spray head is moved from its rest position, thereby helping to create a shallower bend to the neck than would be the case if the neck were inclined to bend or be deflected at its upper or lower ends. The applicant has found that encouraging a gradual deflection of the neck portion across much or most of its length (that is, creating a shallow bend) helps to reduce kinking and a blockage of passageway 9.

Figure 9:
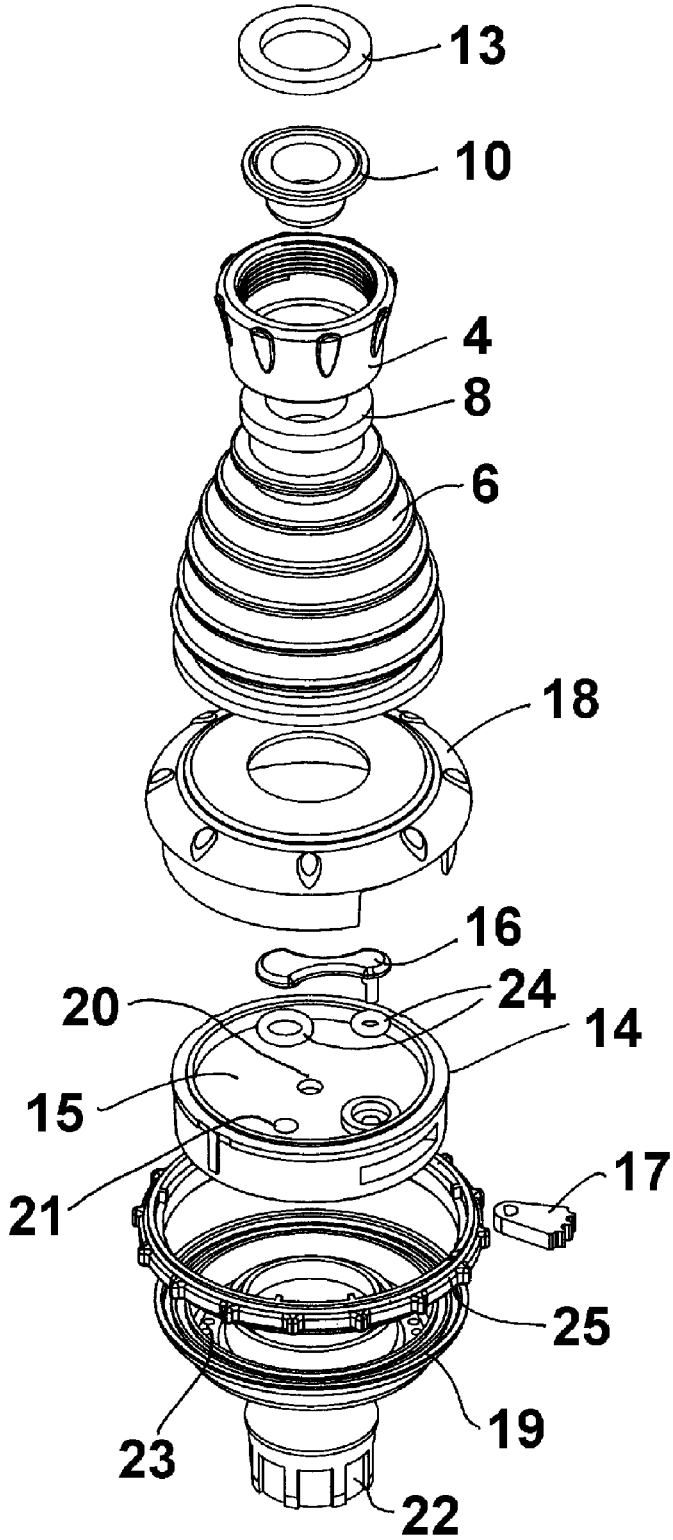
FIG. 9 an exploded view of the faucet sprayer shown in FIG. 1.
Figure 12:
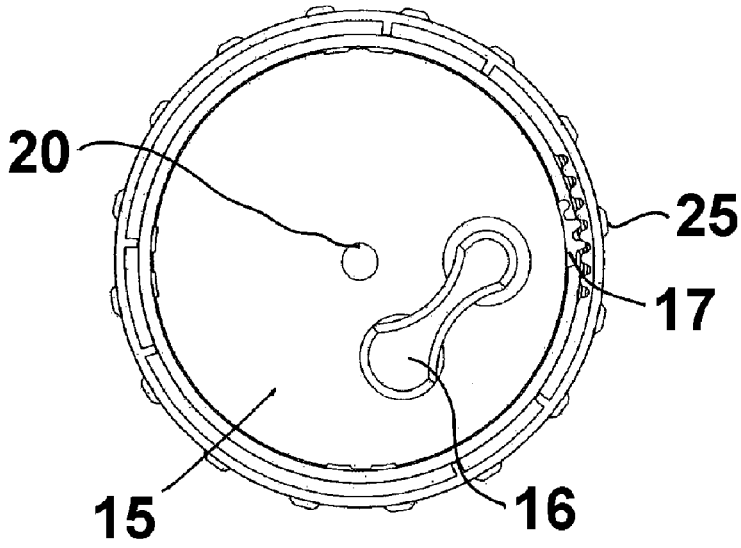
FIG. 12 is a plan view of the valve body of the faucet sprayer shown in FIG. 1 with its swing valve in a first position; and, FIG. 13 is a plan view of the valve body of the faucet sprayer shown in FIG. 1 with its swing valve in a second position.
Figure 13:
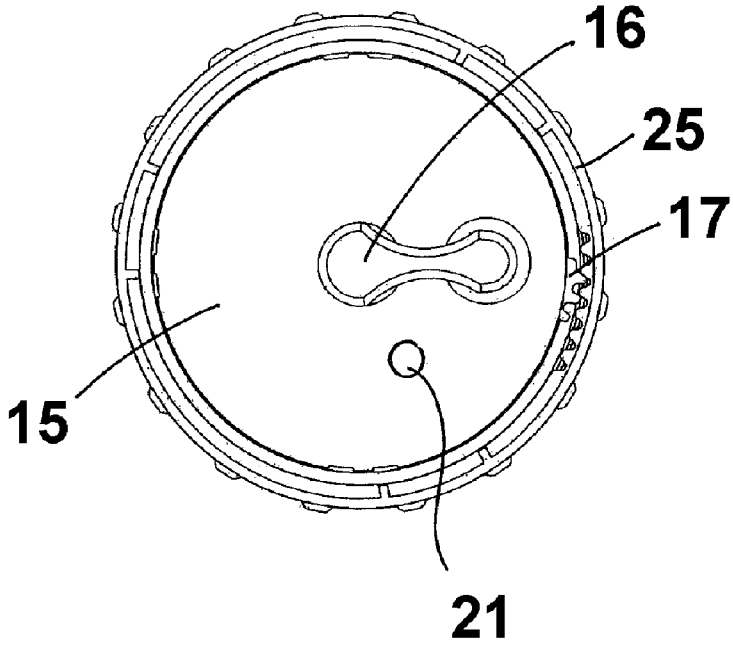

As mentioned, in a preferred embodiment of the invention sprayer 1 permits a consumer to discharge an aerated stream, a concentrated spray, or a combination of a spray and an aerated stream from spray head 5. To accomplish this the spray head preferably includes a valve 14 having at least three positions to enable a consumer to select an aerated stream, a concentrated spray, or a combination of both. With reference to FIGS. 9, 12 and 13, valve 14 is shown as being comprised generally of a valve body 15, a swing arm 16 and an actuation member 17. Valve body 15 is situated between an upper housing 18 and a lower housing 19 of spray head 5 such that all water passing through neck portion 6 must also pass through the valve body prior to exiting the spray head. As shown in the attached drawings, valve body 15 contains two fluid apertures (20 and 21 respectively) extending through it and positioned in a configuration such that water or fluid that passes through aperture 20 is directed to an aerator 22 resulting in an aerated stream discharge, and water or fluid passing through aperture 21 is directed to a spray ring, resulting in a concentrated spray discharge. Activation member 17 is secured to swing arm 16 such that movement of the activation member causes the swing arm to pivot between a position wherein aperture 20 is sealed forcing all fluid to pass through aperture 21, to a position where aperture 21 is sealed forcing all fluid to pass through aperture 20. It will, of course, also be appreciated that swing arm 16 will have an intermediary position between apertures 20 and 21 wherein a portion of the flow will be directed through each of apertures 20 and 21 resulting in a discharge that is a combination of an aerated stream and a concentrated spray. O rings or seals 24 may be incorporated into the valve structure in order to enhance sealing effectiveness and to prevent undesired leakage through the valve body.

In the embodiment of the invention shown in the attached drawings activation member 17 and swing arm 16 are operated through the application of a rotational force to a valve ring 25 positioned about the exterior of spray head 5. Valve ring 25 is operatively connected to activation member 17 such that rotation of the valve ring causes movement of the activation member and ultimately movement of swing arm 16 between its relative positions with respect to fluid apertures 20 and 21. In the embodiment shown the outer end of the activation member contains teeth that mesh with correspondingly shaped teeth on the interior surface of valve ring 25 such that rotation of the valve ring causes a corresponding movement of the activation member. It will be understood that movement of swing arm 16 between its respective positions will thus merely require the application of a rotational force (in one direction or the other) to the valve ring.

It will be appreciated from a thorough understanding of the invention described and shown in the attached drawings that there is provided a new and novel sprayer that may be attached to the spout of a faucet or to the end of a conduit providing a unique ability to permit the spray head of the sprayer to be displaced from a vertical plane in practically any direction while at the same time prevent displacement beyond a pre-determined horizontal angle to prevent splashing or directing the spray up over the side of a sink or other container. Unlike existing ball and socket type sprayers, when the deflecting force applied to the sprayer of the present invention is removed the sprayer will return to its rest position where its discharge will be generally vertically downward. The described sprayer also presents a mechanical structure that is both simplified and cost effective to manufacture. In addition, the integrated rotary valve system of the current sprayer is such that the sprayer's discharge can be alternated between an aerated and a concentrated spray pattern without the application of a vertical load or force to either the sprayer or the faucet to which it is attached.

It is to be understood that what has been described are the preferred embodiments of the invention and that it may be possible to make variations to these embodiments while staying within the broad scope of the invention. Some of these variations have been discussed while others will be readily apparent to those skilled in the art.

We claim:

1. A sprayer for attachment to the spout of a faucet, the sprayer comprising:

(i) a coupling for releasably securing said sprayer to the spout of a faucet;

(ii) a spray head through which fluid may be directed for expulsion from said sprayer; and, (iii) a neck portion connecting said coupling to said spray head, said neck portion including a passageway permitting the flow of fluid from the spout of the faucet to said spray head, said neck portion flexibly resilient and permitting said spray head to be displaced from a rest position where said spray head is generally aligned with the longitudinal axis of said sprayer to a deflected position where said spray head is deflected from said rest position, said resiliency of said neck portion causing said spray head to be normally biased toward said rest position, said neck portion further including a deflection limiter preventing said spray head from being deflected more than a pre-determined amount from the longitudinal axis of said sprayer, said deflection limiter comprised of a series of ring members spaced apart along the longitudinal axis of said neck portion, the diameter of said ring members increasing in a direction from said coupling to said spray head.

2. The sprayer as claimed in claim 1 wherein said pre-determined amount of deflection is less than approximately 90 degrees.

3. The sprayer as claimed in claim 1 including a flow restrictor, said flow restrictor limiting the flow of fluid through said spray head to a pre-determined flow rate for a pre-determined range of fluid pressures.

4. The sprayer as claimed in claim 1 wherein said ring members are approximately equally spaced apart along the longitudinal axis of said neck portion.

5. The sprayer as claimed in claim 1 wherein said spray head includes a valve to permit the discharge of fluid from said sprayer to be in the form of a spray, an aerated stream or a combination of a spray and an aerated stream.

6. The sprayer as claimed in claim 5 wherein said valve is operated through the application of a rotational force applied to the exterior of said spray head.

7. The sprayer as claimed in claim 1 wherein said neck portion is comprised of a thermoplastic material.

8. The sprayer as claimed in claim 1 wherein said passageway within said neck portion is generally hour glass shaped.

9. A sprayer for attachment to the end of a conduit, the sprayer comprising:

(i) a coupling for releasably securing said sprayer to the end of the conduit;

(ii) a spray head through which fluid may be directed for expulsion from said sprayer; and, (iii) a flexibly resilient neck portion connecting said coupling to said spray head and including an internal passageway permitting the flow of fluid from the conduit to said spray head, said passageway within said neck portion generally hour glass shaped, said flexibility and resiliency of said neck portion permitting said spray head to be displaced from a rest position where said spray head is generally aligned with the longitudinal axis of said sprayer to a deflected position where said spray head is deflected from said rest position upon the application of a force to either or both of said neck portion and said spray head at an angle to the longitudinal axis of said sprayer, said resiliency of said neck portion causing said spray head to return to said rest position upon removal of said force, said neck portion further including a deflection limiter preventing said spray head from being deflected more than a pre-determined amount from the longitudinal axis of said sprayer, said deflection limiter comprised of a series of ring members spaced apart along the longitudinal axis of said neck portion with the diameter of said ring members increasing in a direction from said coupling to said spray head.

10. The sprayer as claimed in claim 9 including a flow restrictor, said flow restrictor limiting the flow of fluid through said spray head to a pre-determined flow rate.

11. A sprayer for attachment to the spout of a faucet, the sprayer comprising:

(i) a coupling for releasably securing said sprayer to the spout of the faucet;

(ii) a spray head through which fluid may be directed for expulsion from said sprayer; and, (iii) a neck portion connecting said coupling to said spray head, said neck portion including a passageway permitting the flow of fluid from the spout of the faucet to said spray head, said neck portion flexibly resilient and permitting said spray head to be displaced from a rest position where said spray head is generally aligned with the longitudinal axis of said sprayer to a deflected position where said spray head is deflected from said rest position, said resiliency of said neck portion causing said spray head to be normally biased to said rest position, said neck portion further including a series of ring members spaced apart along the longitudinal axis of said neck portion, the diameter of said ring members increasing in a direction from said coupling to said spray head, when said spray head is deflected by a pre-determined amount from the longitudinal axis of said sprayer said ring members contacting one another and limiting further deflection of said spray head away from the longitudinal axis of said sprayer.

12. The sprayer as claimed in claim 11 wherein said pre-determined amount of deflection is less than approximately 90 degrees.

* * * * *